US005779600A

United States Patent [19]

Pape

[11] Patent Number: 5,779,600

[45] Date of Patent: Jul. 14, 1998

[54] ROWING SIMULATOR

[76] Inventor: Leslie Pape, 43470 Algonquin Dr., Novi, Mich. 48375

[21] Appl. No.: 574,998

[22] Filed: Dec. 19, 1995

[51] Int. Cl.[6] ..... A63B 69/06

[52] U.S. Cl. ..... 482/72; 482/51; 482/119; 482/73

[58] Field of Search ..... 482/72, 73, 110, 482/62–63, 57; 280/245, 246, 254, 258

[56] References Cited

U.S. PATENT DOCUMENTS

| | | | |
|---|---|---|---|
| 2,261,846 | 11/1941 | Dollinger | 482/63 |
| 2,603,486 | 7/1952 | Hughes | 482/110 |
| 4,743,011 | 5/1988 | Coffey . | |
| 4,798,378 | 1/1989 | Jones . | |
| 4,880,224 | 11/1989 | Jonas et al. . | |
| 4,923,193 | 5/1990 | Pitzen et al. | 482/72 |
| 4,984,986 | 1/1991 | Vohnout | 482/73 |
| 4,997,181 | 3/1991 | Lo . | |
| 5,013,033 | 5/1991 | Watterson et al. . | |
| 5,048,824 | 9/1991 | Chen | 482/72 |
| 5,072,929 | 12/1991 | Peterson et al. . | |
| 5,076,573 | 12/1991 | Lo . | |
| 5,403,255 | 4/1995 | Johnston | 482/51 |
| 5,542,893 | 8/1996 | Peterson et al. | 482/72 |

*Primary Examiner*—Jerome Donnelly

*Attorney, Agent, or Firm*—Reising, Ethington, Barnard & Perry, PLLC

[57] ABSTRACT

A rowing simulator including a frame, a seat slidably mounted on the frame, a pair of adjustable foot rests, and, on each side of the frame, a rotatably mounted flywheel, a driven wheel secured to the flywheel, a rotatably mounted drive wheel, and connector means interconnecting the drive wheel to the driven wheel. An oar is pivotally connected to a rotatable pivot linked to a first universal coupling. The latter is connected to a drive shaft which, in turn, is connected to a second universal coupling connected to the drive wheel.

40 Claims, 3 Drawing Sheets

12
14
16
18
20
22
24
26
28
30
32
34
36
38
40
42
44
46
47
48
50
52
54
56
58
60
70

ROWING SIMULATOR

FIELD OF THE INVENTION

This invention relates generally to exercise machines and, more particularly, to an improved exercise rowing simulator.

BACKGROUND ART

Heretofore, many exercise rowing machines have been promoted. Among them are the following:

Coffey U.S. Pat. No. 4,743,011 discloses an exercise rowing machine including a flywheel and cam sector arms which are pivoted to rotate with the machine's oars.

Jones U.S. Pat. No. 4,798,378 discloses a rowing exercise machine including a flywheel and a one-way clutch connected thereto. The flywheel has a non-magnetic, conducting rim portion that passes through a magnetic field created by a stationary field piece having one or more field coils.

Jonas et al U.S. Pat. No. 4,880,224 discloses a rowing machine including a flywheel driven by a planetary gear system having a rotatable carrier, pinion gears mounted in the carrier, a stationary ring gear and a central gear.

Lo et al U.S. Pat. No. 4,997,181 discloses an exercise rowing unit including a wind-drag type flywheel with fan-type blades, and a one-way clutch with an associated horizontal handle and rope sheave.

Watterson et al U.S. Pat. No. 5,013,033 discloses a rowing apparatus including an axle journaled in a frame, and having a cable extending from a handle, a spiral configured spring, and a flywheel all associated with the axle.

Peterson et al U.S. Pat. No. 5,072,929 discloses an exercise rowing machine including two flywheels, a handle interconnected by means of a cord to the first flywheel, and a seat interconnected by means of a cord to the second flywheel.

Lo U.S. Pat. No. 5,076,573 discloses a magnetic resistance type stationary rowing unit.

Rekers U.S. Pat. No. 5,382,210 discloses a rowing simulator having a slidably mounted energy dissipating unit including a flywheel with blades or fins, a one-way clutch reduction gears, a handle and chain, and a chain take-up device encompassing an elastic cord and five pulleys associated with the chain and elastic cord.

SUMMARY OF THE INVENTION

A general object of the invention is to provide a realistic, simplified, compact, and efficient rowing simulator.

Another object of the invention is to provide a rowing simulator including a pair of oar assemblies for actuating oppositely disposed drive wheels operating driven wheels connected to flywheels.

A further object of the invention is to provide a rowing simulator including right and left hand oars, each connected through a pivot on an outrigger linked to one of two universal couplings with an intermediate drive shaft to a drive wheel, in turn, connected via one of a belt or chain or gear wheel to drive a driven wheel secured to a flywheel having a resistance device associated therewith.

These and other objects and advantages will become more apparent when reference is made to the following drawings and the associated description.

BEST MODE FOR CARRYING OUT THE INVENTION

Figure 1:
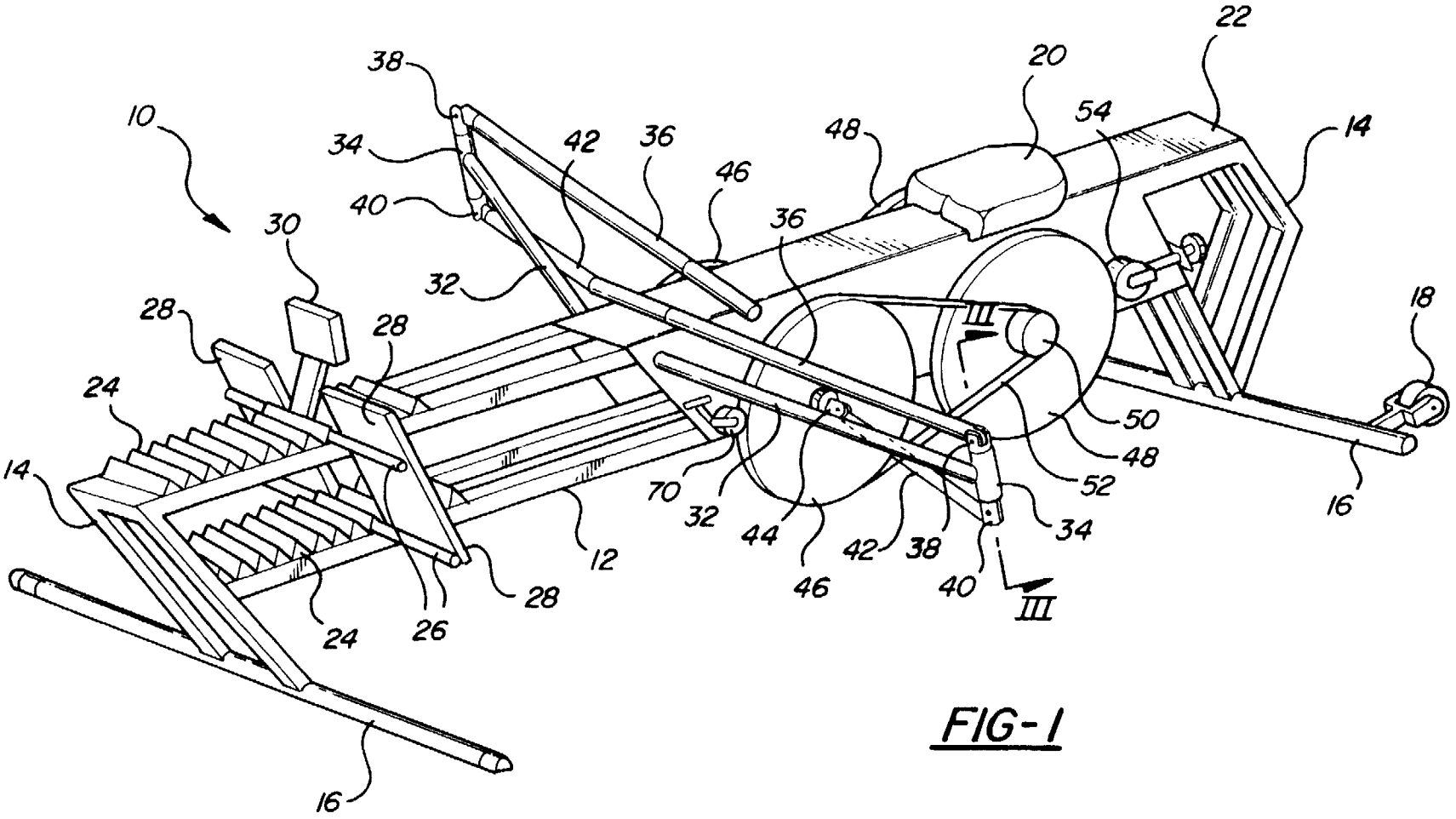
FIG. 1 is a perspective view of a rowing simulator embodying the invention.

Referring now to the drawing in greater detail, there is illustrated a rowing simulator 10 including a framework 12 having forward and rear braces 14 extending to support bars 16. A pair of wheels 18 are secured adjacent opposite ends of the rear support bar, adapted to permit manual lifting of the forward end of the simulator 10 to thereby readily roll the simulator 10 to different location.

A seat 20 is slidably mounted on runners 22 secured along the upper surface of the framework 12. A series of upper and lower notched plates 24 are formed at the forward end of the framework 12. Parallel rods 26 are adapted to being adjustably mounted across the respective upper and lower notched plates 24. A pair of foot rests 28 are secured to the rods 26 on opposite sides of the framework 12. An electronic measuring device 30, such as a speedometer, or the like, is secured at a convenient location, such as to the upper rod 26 intermediate the pair of foot rests 28. The device 30 is adapted to interpret information generated from detection devices (not shown) on one of the flywheel, seat, or other selected device, to disclose various readouts, e.g., distance travelled, time lapsed, strokes per minute, and/or energy expended, etc.

Figures 2, 4B, 6:
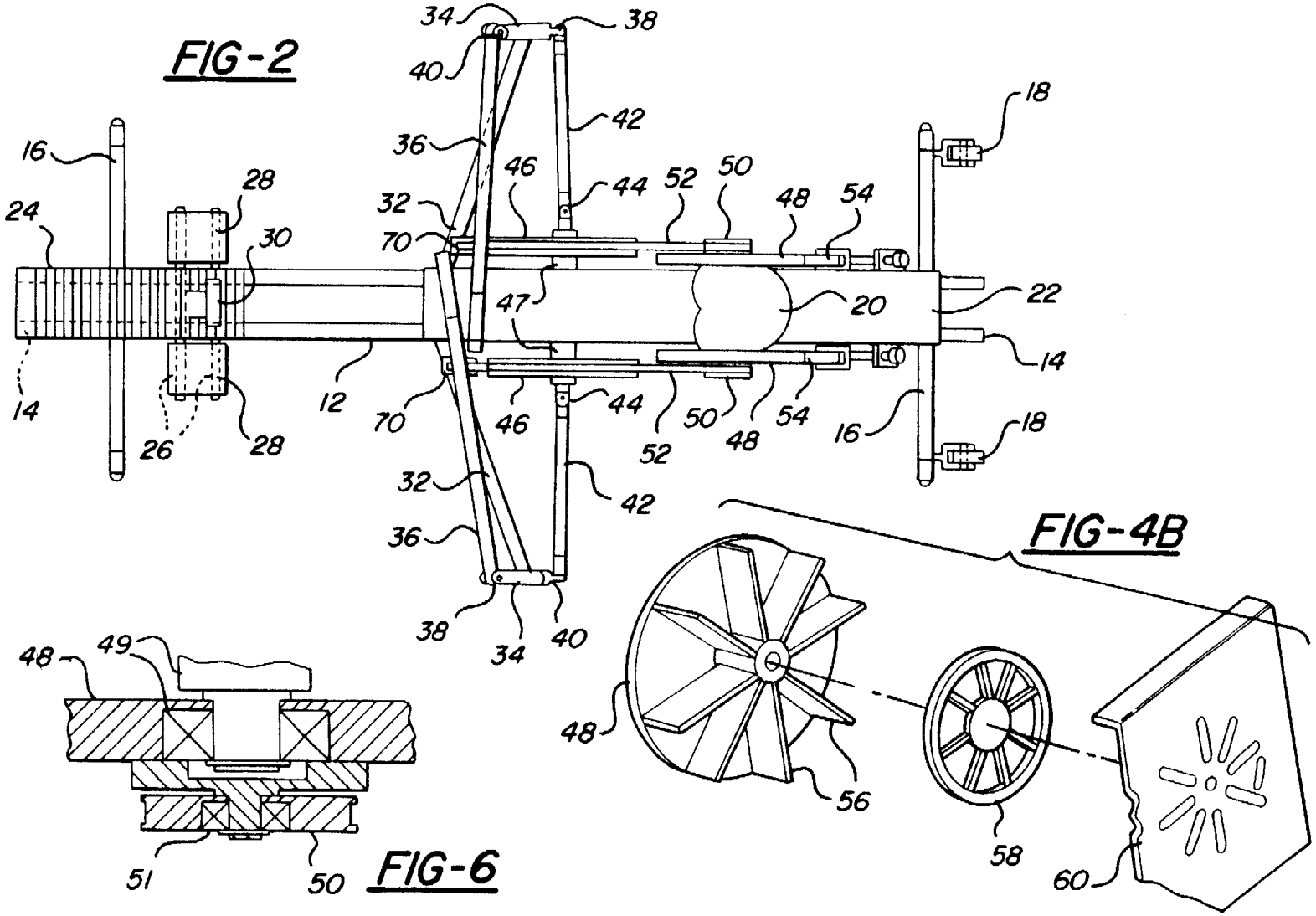
FIG. 2 is a plan view of the FIG. 1 rowing simulator.
FIG. 4, 4A, 4B and 5 are perspective views of alternate embodiments of portions of the FIGS. 1 and 2 structures.
FIG. 6 is an enlarged fragmentary cross-sectional view of a portion of the FIGS. 2 and 2 structure.
Figure 3:
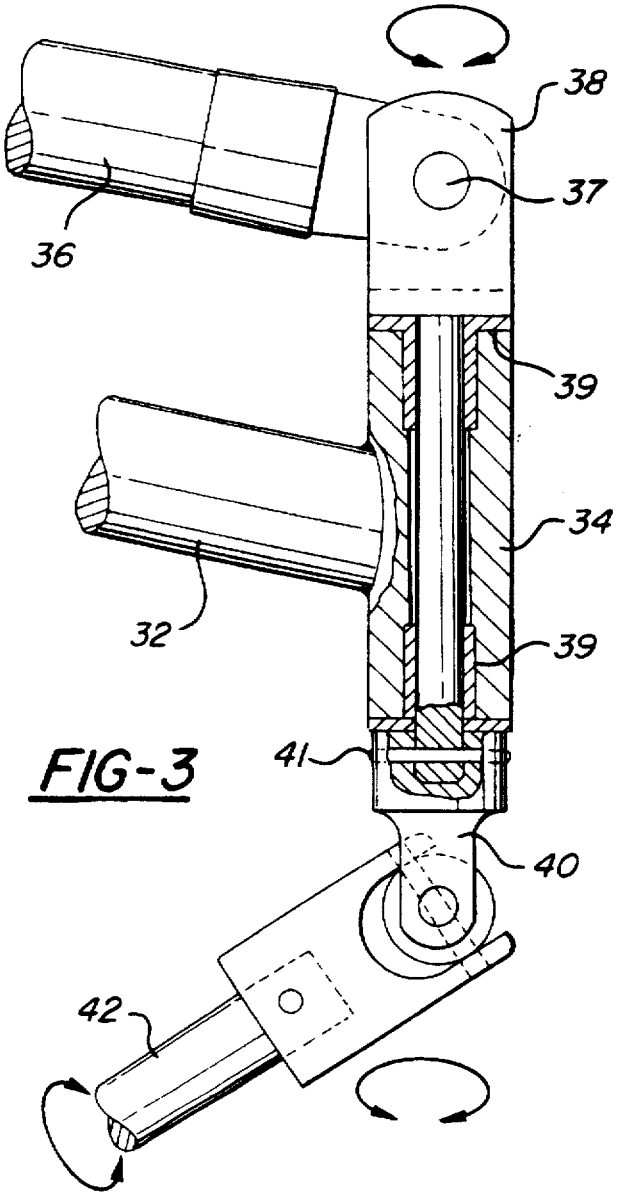
FIG. 3 is a cross-sectional view taken along the plane of the line 3—3 of FIG. 2, and looking in the direction of the arrows.

A pair of outrigger arms 32 are pivotally connected to respective sides of the framework 12. A vertically oriented outrigger sleeve 34 is secured to the distal end of each arm 32 to form a "T" therewith. An oar 36 is pivotally connected at one end thereof to a pivot pin 37 connected to a stem 38 pivotally extended through the sleeve 34. Oppositely disposed bushings 39 are mounted between the ends of the sleeve 34 and surfaces of the stem 38. A universal coupling 40 is connected between the lower end of each sleeve 34 and a respective drive shaft 42 by virtue of a pin 41 extending through adjacent ends of the coupling 40 and the stem 38. Each drive shaft 42 extends laterally to a second universal coupling 44 connected so as to drive respective drive wheels 46. The latter are rotatably mounted suitable shafts 47 (FIG. 2) and bearings (not shown) on oppositely disposed sides of the framework 12.

Figure 5:
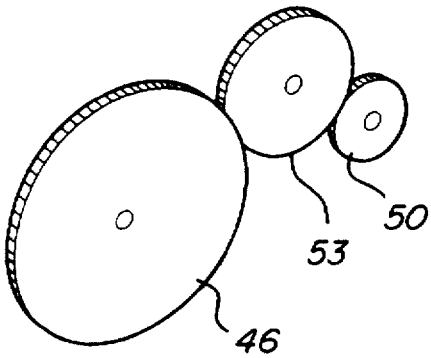

A pair of flywheels 48 are rotatably mounted on a suitable shaft/bearing combination 49 (FIG. 6) on oppositely disposed sides of the framework 12 rearward of the respective drive wheels 46. A driven wheel 50 is secured to a suitable freewheel clutch, represented at 51 in FIG. 6 on the outer side of each flywheel 48. One of a V-belt or toothed belt or linked chain 52, or, as shown in FIG. 5, where the drive wheel 46 and driven wheel 50 are each formed as spur gears, an idler gear 53 in mesh with both operatively connect each drive wheel 46 to the adjacent driven wheel 50 and, hence, to the flywheel 48.

Figure 4:
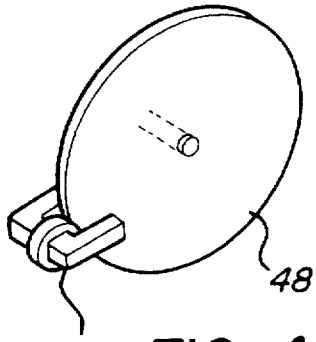
Figure 4A:
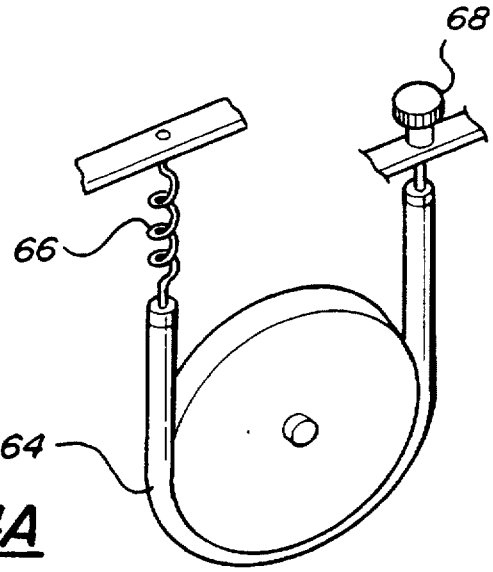

An adjustable spring tensioned roller 54 mounted on the framework 12 in engagement with the flywheel 50 to provide resistance to the free wheeling of the flywheel. Alternatively, in lieu of the roller 54, resistance could be provided by vanes 56 (FIG. 4B) formed on the flywheel and covered by a vent door 58 and an outer cover 60, an adjustable electromagnetic brake 62 (FIG. 4), or with a lapped belt 64 (FIG. 4A) around the flywheel perimeter secured to a spring 66 at one end and a tensioner 68 at the other end.

As an option, a roller 70 may be mounted on the framework 12 in engagement with the drive wheel 46 to add resistance thereto to simulate the weight of the oar on recoil, for example.

In operation, while each oar 36 may be moved in any direction about the pivot 38, when the oar is pulled toward the user, to thereby rotate the pivot pin 37 and the stem 38, the latter, through the connector pin 41 to the first universal coupling 40, serves to rotate the drive shaft 42, and, hence, the second universal coupling 44 and the associated drive wheel 46. Then, through the belt or chain 52, or idler gear 53, the driven wheel 50 and, hence, the flywheel 48 are driven against the resistance of the adjustable spring tensioned roller 54. In other words, the driven wheel 50, is driven on the oar 36 pull stroke and freewheels on the flywheel clutch 51 on the oar push stroke, while the flywheel 48 continues to freewheel.

If desired, a plurality of simulators 10 may be linked together, in line, by joining the leading and trailing ends to simulate a double scull, quad scull, or an eight scull, for example. Additionally, the linked-together simulators may be fitted on alternate sides only with the oar, drive, and flywheel components to simulate any multiple of rowing pairs.

COMMERCIAL APPLICABILITY

It should be apparent that the invention provides a realistic, simplified, compact, and efficient rowing simulator.

It should also be apparent that the invention provides a machine capable of simulating all methods of rowing and sculling.

While but one general embodiment of the invention has been shown and described, other modifications thereof are possible within the scope of the following claims.

What is claimed is:

1. A rowing simulator comprising a frame, a seat slidably mounted on the frame, a pair of foot rests adjustably mounted on the frame, a flywheel rotatably mounted on the frame, a driven wheel secured to the flywheel, a drive wheel rotatably mounted on the frame, connector means interconnecting the drive wheel to the driven wheel, universal means operatively connected to said drive wheel, a rotatable pivot linked to said universal means, and an oar connected to rotate said pivot, whereby said pivot rotates said universal means which, in turn, rotates said drive wheel to, thereby, rotate said driven wheel and said flywheel, wherein said universal means includes a first universal coupling adapted to be rotated by said pivot, a drive shaft rotated by said first universal coupling, a second universal coupling rotated by said drive shaft to drive said drive wheel.

2. The rowing simulator described in claim 1, and a T-shaped outrigger secured to a side of said frame, and said pivot linked to said universal means through a portion of said T-shaped outrigger.

3. The rowing simulator described in claim 1, and resistance means operatively connected to said flywheel.

4. The rowing simulator described in claim 3, wherein said resistance means is an adjustable spring tensioned roller in rolling engagement with said flywheel.

5. The rowing simulator described in claim 1, wherein said connector means is an endless belt.

6. The rowing simulator described in claim 5, wherein said endless belt is one of a V-belt, or toothed belt, and a flat belt.

7. The rowing simulator described in claim 1, wherein said connector means is an endless chain.

8. The rowing simulator described in claim 1, wherein said drive and driven wheels are spur gears, and said connector means is an idler gear intermeshing with both spur gears.

9. The rowing simulator described in claim 1, wherein said oar is pivotally connected to said pivot.

10. The rowing simulator described in claim 2, wherein said T-shaped outrigger includes a solid arm extending from a side of said frame, and a sleeve connected at a mid-point therealong to the distal end of said solid arm, a stem extending through said sleeve, with said pivot secured to one end of said stem, and a pin secured through the other end of said stem and through an end of said first universal coupling.

11. The rowing simulator described in claim 1, with duplicate components on opposite sides of said frame.

12. The rowing simulator described in claim 1, and a series of upper and lower slots formed on the forward end of said frame, and a pair of upper and lower transverse rods interconnecting said pair of foot rests for mounting in selected upper and lower slots to adjust said foot rests longitudinally along said frame.

13. The rowing simulator described in claim 1, and a runner mounted on the top of said frame, said seat being slidable on said runner.

14. A rowing simulator comprising a frame, a seat, resisting-force supplying means mounted on the frame, foot resting means adjustably mounted on the frame, a rotatable pivot drivingly connected to said resisting-force supplying means, and an oar-like member connected to rotate said pivot, whereby said pivot drives said resisting-force supplying means, characterized in that universal means operatively interconnects said pivot and said resisting-force supplying means, wherein said universal means includes a first universal coupling adapted to be rotated by said pivot, a drive shaft adapted to be rotated by said first universal coupling, and a second universal coupling adapted to be rotated by said drive shaft to drive said resisting-force supplying means.

15. A rowing simulator according to claim 14, and further comprising a driven wheel secured to a flywheel of said resisting-force supplying means, a drive wheel rotatably mounted on the frame, and connecting means interconnecting said drive wheel and said driven wheel, said universal means being operatively connected to said flywheel by way of said drive wheel, said connecting means and said driven wheel.

16. A rowing simulator according to claim 14, and further comprising an adjustable resisting-force supplying means serving to resist return strokes of said oar-like member.

17. A rowing simulator according to claim 16, wherein the resisting-force supplying means comprises an adjustable spring-tensioned roller.

18. A rowing simulator according to claim 14, wherein said oar-like member is connected to said pivot by way of a pivot pin so as to be upwardly and downwardly pivotable relative thereto.

19. A rowing simulator according to claim 16, and further comprising a one-way clutch means connected between said pivot and said resisting-force supplying means and whereby said resisting-force supplying means does not resist return strokes of said oar-like member.

20. A rowing simulator according to claim 14, and further comprising fastening means at at least one end of said frame whereby said simulator is connected front-to-rear to one or more similar rowing simulators.

21. A rowing simulator according to claim 14, and further comprising a series of upper and lower slots formed at the forward end of said frame, and a pair of upper and lower transverse rods for mounting in selected upper and lower slots to adjust along said frame, said foot resting means comprising a pair of foot rests at respective opposite sides of said frame and interconnected by said transverse rods.

22. A rowing simulator, comprising a frame, outrigging means extending laterally from one side of said frame, a pivot having an axis of turning inclined to the horizontal and carried by an outer end portion of said outrigging means, receiving means at an upper end portion of said pivot for receiving an oar-like member for oscillating said pivot about said axis, a transmission member extending towards said frame from a lower end portion of said member, said transmission member being connected at an outer end portion thereof to said pivot at said lower end portion for being driven by said pivot, wherein said transmission member has said inner end portion translationally fixed relatively to said frame.

23. A rowing simulator according to claim 22, wherein said transmission member comprises a shaft.

24. A rowing simulator according to claim 23, wherein said shaft is connected to said pivot by way of a first universal coupling at said outer end portion and is connected to said resisting-force supplying means by a second universal coupling at said inner end portion.

25. A rowing simulator according to claims 22 or 24, and further comprising one-way clutch means connected between said pivot and said resisting-force supplying means and whereby said resisting-force supplying means does not resist return strokes of said oar-like member.

26. A rowing simulator according to claims 22 or 24, and further comprising an adjustable resisting-force supplying means serving to resist return strokes of said oar-like member.

27. A rowing simulator according to claims 22 or 24, wherein the resisting-force supplying means comprises an adjustable spring-tensioned roller.

28. A rowing simulator according to claims 22 or 24, and further comprising-fastening means at at least one end of said frame whereby said simulator is connected front-to-rear to one or more similar rowing simulators.

29. A rowing simulator, comprising a frame, first and second pivots at respective opposite sides of said frame and having respective axes of turning inclined to the horizontal, first and second receiving means at respective zones of said first and second pivots for receiving respective first and second oar-like members for oscillating the respective pivots about their respective axes, and resisting-force supplying means to which said first and second pivots are drivingly connected, characterized in that said resisting-force supplying means comprises first and second resisting-force supplying means the resisting forces supplied by which are substantially independent of one another.

30. A rowing simulator according to claim 29, wherein said first and second resisting-force supplying means are disposed at respective opposite sides of said frame.

31. A rowing simulator according to claim 30, wherein said first and second resisting-force supplying means comprise respect first and second flywheels disposed at said respective opposite sides of said frame.

32. A rowing simulator according to claim 31, wherein said first and second flywheels are rotatably mounted upon a common axle so as to be rotatable independently of one another.

33. A rowing simulator according to claims 29 or 31, and further comprising first and second one-way clutch means connected between the respective first and second pivots and the respective first and second resisting-force supplying means and whereby said first and second resisting-force supplying means do not resist return strokes of the respective first and second oar-like members.

34. A rowing simulator according to claims 29 or 31, and further comprising first and second adjustable resisting-force supplying means serving to resist return strokes of said first and second oar-like members.

35. A rowing simulator according to claims 29 or 31, wherein each resisting-force supplying means comprises an adjustable spring-tensioned roller.

36. A rowing simulator according to claims 29 or 31, and further comprising fastening means at at least one end of said frame whereby said simulator is connected front-to-rear to one or more similar rowing simulators.

37. A rowing simulator comprising a frame, a seat slidably mounted on the frame, a pair of foot rests adjustably mounted on the frame, a pair of flywheels rotatably mounted on the frame, a driven wheel secured to each flywheel, a pair of drive wheels rotatably mounted on the frame, connector means interconnecting each drive wheel to a respective driven wheel, universal means operatively connected to each said drive wheel, a rotatable pivot linked to each said universal means, and a pair of oars connected to rotate said respective pivots, whereby each said pivot rotates a respective universal means which, in turn, rotates a respective drive wheel to, thereby, rotate a respective driven wheel and a respective flywheel.

38. A rowing simulator comprising a frame, a single seat for an individual user, a pair of resisting-force supplying means mounted on the frame, foot resting means adjustably mounted on the frame, a rotatable pivot drivingly connected to each said resisting-force supplying means, and a pair of substantially oppositely disposed oar-like members connected to rotate each said pivot, whereby each said pivot drives a respective resisting-force supplying means, characterized in that a pair of universal means operatively interconnect respective pivots and respective resisting-force supplying means, wherein each of said pairs of resisting-force supplying means includes a flywheel.

39. A rowing simulator according to claim 38, and further comprising a driven wheel secured to each flywheel, a pair of drive wheels rotatably mounted on the frame, and connecting means interconnecting each said drive wheel and a respective driven wheel, said pair of universal means being operatively connected to respective flywheels by way of respective drive wheels, connecting means and driven wheels.

40. A rowing simulator according to claim 38 or 39, wherein each said universal means includes a first universal coupling adapted to be rotated by one of said pivots, a drive shaft adapted to be rotated by each said first universal coupling, and a second universal coupling adapted to be rotated by each said drive shaft to drive each said resisting-force supplying means.

* * * * *

UNITED STATES PATENT AND TRADEMARK OFFICE

CERTIFICATE OF CORRECTION

PATENT NO. : 5,779,600

DATED : July 14, 1998

INVENTOR(S) : Leslie Pape

It is certified that error appears in the above-identified patent and that said Letters Patent is hereby corrected as shown below:

Column 5, line 17, delete "member,", and substitute therefor --pivot, resisting-force supplying means to which said transmission member is drivingly connected at an inner end zone of said member,--.

Signed and Sealed this

Ninth Day of March, 1999

*Attest:*

*Attesting Officer*

Q. TODD DICKINSON

*Acting Commissioner of Patents and Trademarks*